United States Patent [19]

Field et al.

[11] Patent Number: 4,757,566

[45] Date of Patent: Jul. 19, 1988

[54] CONTROL OF TORQUE IN FLOOR MAINTENANCE TOOLS BY DRIVE MOTOR LOAD

[75] Inventors: Bruce F. Field, Minneapolis; Joseph G. Kasper, Golden Valley, both of Minn.

[73] Assignee: Tennant Company, Minneapolis, Minn.

[21] Appl. No.: 78,204

[22] Filed: Jul. 27, 1987

[51] Int. Cl.[4] ..... A47L 11/16

[52] U.S. Cl. ..... 15/49 R; 15/320; 51/177; 340/679

[58] Field of Search ..... 15/49 R, 49 C, 50 R, 15/50 C, 50 A, 51, 52, 98, 320, 340, 82, 383–385, 389, 87; 51/174–177; 299/39, 41; 144/117 R, 118, 119 R, 119 A; 340/540, 679, 691

[56] References Cited

U.S. PATENT DOCUMENTS

| | | | |
|---|---|---|---|
| 2,622,254 | 12/1952 | Mendelson . | |
| 2,930,055 | 3/1960 | Fallen et al. . | |
| 2,978,719 | 4/1961 | Arones . | |
| 3,204,280 | 9/1965 | Campbell . | |
| 3,277,511 | 10/1966 | Little et al. . | |
| 3,345,671 | 10/1967 | Wilson et al. . | |
| 3,510,900 | 5/1970 | Roslund | 15/82 |
| 3,702,149 | 11/1972 | Thompson . | |
| 3,871,051 | 3/1975 | Collier . | |
| 3,942,215 | 3/1976 | Olds . | |
| 4,009,500 | 3/1977 | Ashton . | |
| 4,041,567 | 8/1977 | Burgoon . | |
| 4,138,756 | 2/1979 | Krier et al. . | |
| 4,173,052 | 11/1979 | Burgoon et al. . | |
| 4,218,798 | 8/1980 | Block . | |
| 4,251,896 | 2/1981 | Block . | |
| 4,295,243 | 10/1981 | King . | |
| 4,393,534 | 7/1983 | Lee et al. . | |
| 4,418,342 | 11/1983 | Aschoff et al. | 15/49 C |
| 4,447,930 | 5/1984 | Glenn, III et al. . | |
| 4,492,002 | 1/1985 | Waldhauser et al. . | |
| 4,506,405 | 3/1985 | Block . | |
| 4,633,541 | 1/1987 | Block . | |
| 4,674,142 | 6/1987 | Meili | 15/49 R |

*Primary Examiner*—Edward L. Roberts

*Attorney, Agent, or Firm*—Kinzer, Plyer, Dorn, McEachran & Jambor

[57] ABSTRACT

An automatic tool torque compensator for a surface maintenance machine such as a sweeper or scrubber includes an actuator for raising and lowering one or more rotatable surface maintenance tools and one or more electric or hydraulic motors for driving the tools. There is a circuit for sensing the current load in at least one of the electric motors, or the differential pressure in one or more of the hydraulic motors, and providing a signal representative thereof. There is a circuit for manually selecting a desired tool torque to be applied from a plurality of possible tool torques and for providing an electrical signal representative thereof. The electrical signal representative of the desired tool torque to be applied to the tools and the drive motor load current signal or the differential hydraulic pressure signal representative of actual tool torque applied to the tools are used to control the actuator for raising and lowering the surface maintenance tools. This automatically varies the pressure of the tools against the surface to maintain a desired torque in the tools at a nearly constant value even though the surface may vary in its resistance to the tools due to variations in its elevation or texture, or the degree of soilage on it.

14 Claims, 4 Drawing Sheets

Fig. 4.
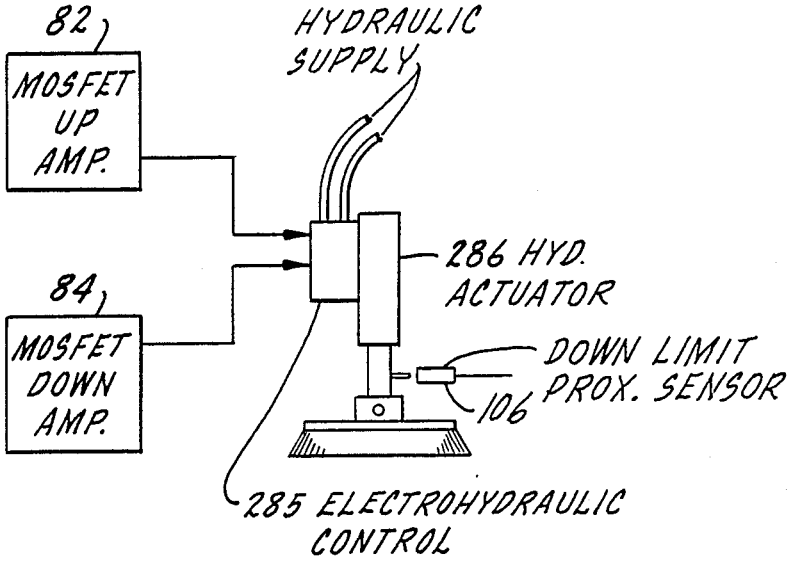
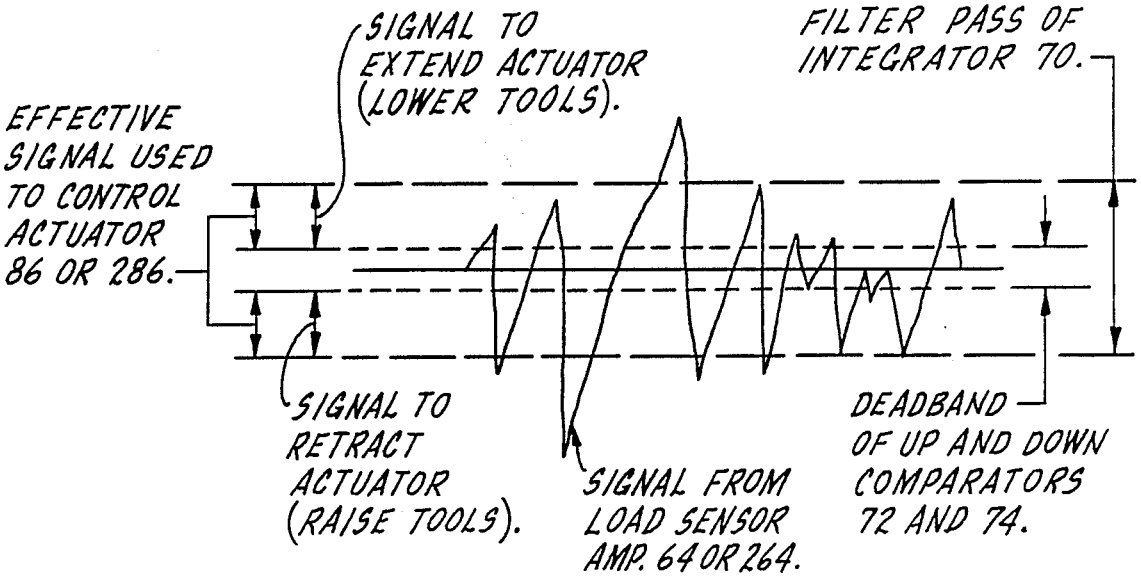
Fig. 5.

CONTROL OF TORQUE IN FLOOR MAINTENANCE TOOLS BY DRIVE MOTOR LOAD

SUMMARY OF THE INVENTION

The present invention relates to an automatic torque compensator for the rotatable tools of a surface maintenance machine and has particular application to an electric control which raises and lowers the surface maintenance tools to maintain a desired tool torque, although the surface being maintained may be irregular and vary in elevation or texture or in the degree of soilage on it.

A primary purpose of the invention is an automatic tool torque compensator which may have multiple settings for desired tool torque and which will sense the load current of the electric motor or the differential hydraulic pressure of the hydraulic motor driving the surface maintenance tools to automatically maintain the applied tool torque at a selected setting by varying the pressure of the tools against the surface being maintained, although there may be variations in the surface.

Another purpose is an automatic tool torque compensator for use on a surface maintenance machine such as a scrubber or sweeper which utilizes a comparison circuit in which a signal representative of the load current in an electric motor or the differential hydraulic pressure in a hydraulic motor driving the surface maintenance tools is modified by a signal representative of the desired tool torque with the resultant being compared with a reference to maintain applied tool torque at a desired level by controlling the pressure of the tools against the surface being maintained.

Another purpose is an automatic tool torque compensator as described which automatically raises the maintenance tools in the event of an abnormal condition in the drive motors therefor.

Another purpose is a simply constructed, reliably operable electronic circuit for automatically controlling tool torque in a surface maintenance machine.

Another purpose is an automatic tool torque compensator as described which not only includes multiple discrete levels of desired tool torque, but which includes, for a limited period of time, a substantially increased level of desired tool torque.

Another purpose is an electric circuit for automatically controlling the tool torque of a surface maintenance machine which may be applied to various types of surface maintenance machines having different surface maintenance tools and providing for different surface maintenance functions.

Other purposes will appear in the ensuing specification, drawings and claims.

BRIEF DESCRIPTION OF THE DRAWINGS

The invention is illustrated diagrammatically in the following drawings wherein:

FIG. 4 is an illustration of a modified form of actuator for raising and lowering the tools; and FIG. 5 is a diagram of the amplified load signal, showing the effects of a neutral deadband and a low pass filter on the signal.

DESCRIPTION OF THE PREFERRED EMBODIMENT

Figure 1:
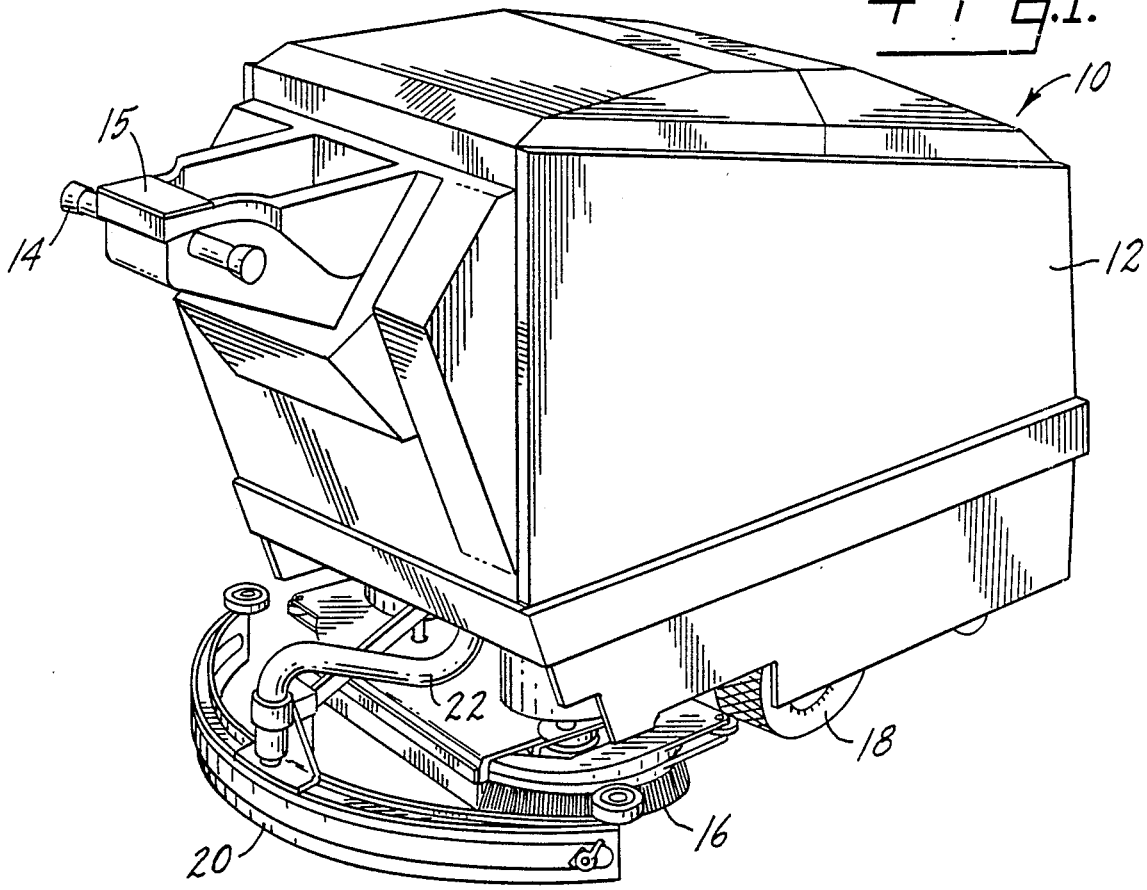
FIG. 1 is a perspective of a typical walk-behind surface maintenance machine which may utilize the control of the present invention.

The present invention relates to an automatic tool force compensator of the type generally disclosed in our copending application Ser. No. 839,877, filed Mar. 14, 1986, now U.S. Pat. No. 4,679,271, and assigned to the assignee of the present application. In that application the invention is specifically directed to a means for measuring the actual level of tool force against a surface being maintained by weight of the tools on the underlying surface and for comparing that force with a reference and then raising or lowering the surface maintenance tools in accordance with the comparison to maintain a constant tool force on the surface being maintained. The invention of that application further includes means for sensing the load on the surface maintenance tool drive means and for utilizing that sensed load signal, after being compared with a reference, as a companion means for raising or lowering the surface maintenance tools.

In the present invention there may be one or more rotatable surface maintenance tools such as sweeping brushes, scrubbing brushes or polishing pads, and there may be one or more electric motors driving said surface maintenance tools. Those versed in the art are aware that in an electric DC motor the current which the motor draws is proportional to the load on the motor. Therefore, a signal representative of the current in one or more of the tool drive motors can represent the torque which is being applied to the tools by the drive motor. The invention can also be applied on a surface maintenance machine having rotatable tools which are driven by hydraulic motors rather than electric motors. In this case an electrical signal representative of the load in the hydraulic motors can be obtained from a differential pressure transducer placed across the hydraulic lines leading to and away from one or more of the hydraulic motors. This signal can represent the torque applied to the tools.

There are multiple discrete levels of tool torque which are available to the machine operator, although the invention in its broadest sense is equally applicable to a machine in which there are an infinite number of levels of tool torque available. Once an operator has determined what level of tool torque is desired, which is done through manipulation of the control switches forming a part of the electronic control system, the tool torque compensator will automatically maintain tool torque at the desired setting, although the surface being maintained may vary in elevation or texture. It will do this by using an electrical signal representative of current load for the tool drive motor and a signal representative of the desired level of tool torque and integrating them to produce a signal to raise or lower the surface maintenance tools, which will change their pressure against the surface being maintained.

The torque developed in the tools is a function of the downward pressure of the tools against the surface being maintained and the resistance of that surface or the soilage on it to the rotation of the tools. Various surfaces will offer various degrees of resistance depending on their texture and the soilage on them. However, the torque in the tools can be held at a constant value by adjusting the downward pressure of the tools against the surface as needed, even though that surface may be varying in texture and/or type of soilage. In doing this, the vertical position of the tools will vary somewhat. This, however, does not detract from the quality of the maintenance job being performed, because an essentially constant amount of work is being done by the tools at all times at any given selected value of tool torque. The application of constant torque is advantageous in that it increases tool life, reduces the energy needed by the machine, and keeps the drive motors within their rated capacity, while providing a more uniform floor cleaning when compared with machines which do not have tool torque control.

In FIG. 1, a vehicle such as a scrubber is indicated generally at 10 and may be of a type manufactured by Tennant Company of Minneapolis, Minn., assignee of the present invention, or a subsidiary, Tennant Trend, Inc., of Niagara Falls, N. Y. The scrubber may include a housing 12 and a rear operating control 14 which is used by the operator to control vehicle speed and direction. A control panel 15 is used by the operator to control tool torque, as described herein. There may be a pair of rotating brushes or pads, one of which is indicated at 16, and one of the two drive wheels for the vehicle is indicated at 18. A squeegee 20 is normally positioned at the rear of the vehicle and is effective, as is known in the art, to squeegee the floor and remove any standing water. Normally, there will be a vacuum device attached to the squeegee which will apply suction to remove standing water collected by the squeegee The vacuum hose is indicated at 22.

Although the invention will be described in connection with a scrubber, it should be clear that the control has application to other types of vehicles using surface maintenance tools, such as a sweeper or a polishing or burnishing machine.

The surfaces which may be maintained by such machines may also be of various types. They may include floors of all types, ship decks, streets, driveways and parking lots, or any other such surface requiring sweeping, scrubbing, polishing, buffing or burnishing.

Figure 2B:
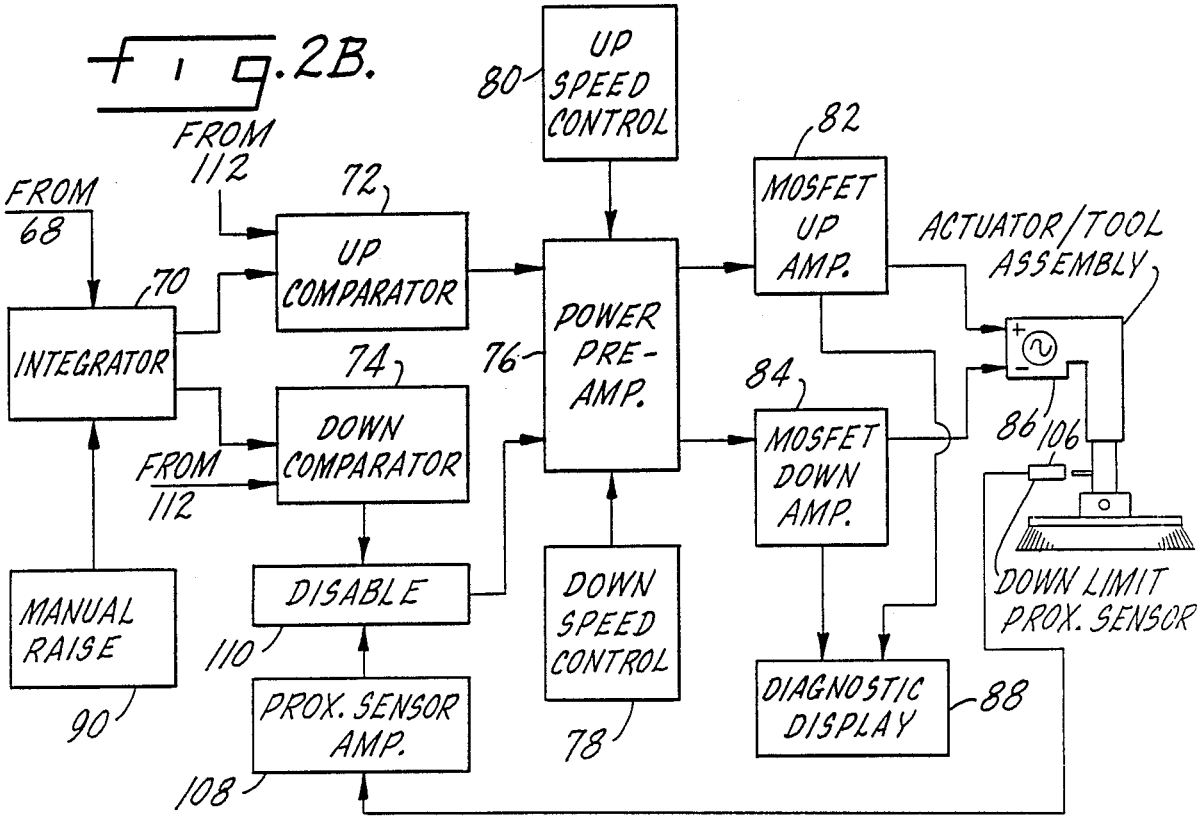
FIGS. 2A and 2B together constitute a block diagram illustrating the control for maintaining a desired torque in the surface maintenance tools.
Figure 2A:
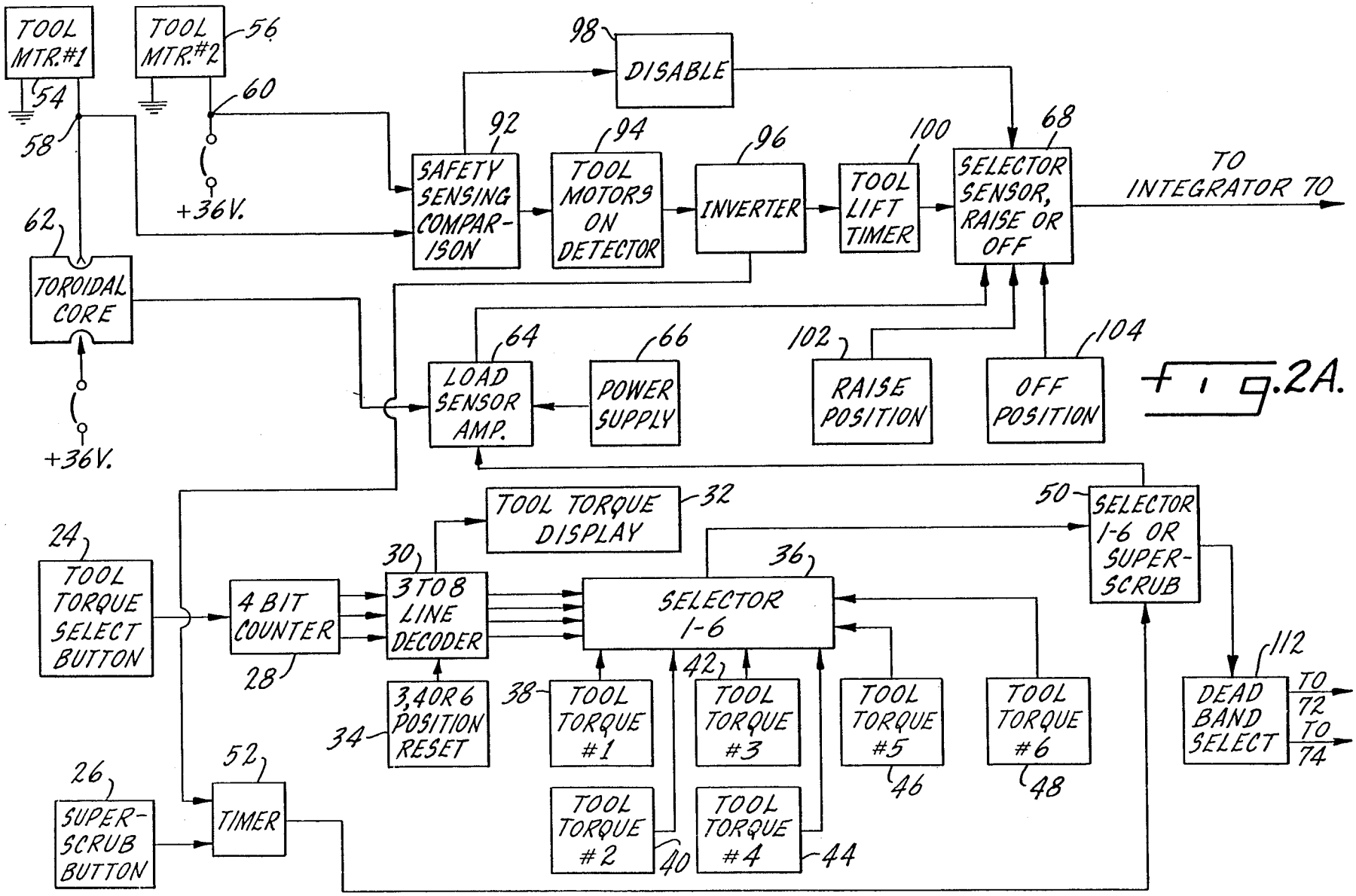

The control circuit is illustrated in FIGS. 2A and 2B. The operator has, among other control switch means, two switches for use in selecting tool torque. There is a tool torque select button 24 and a superscrub button 26. Operation of superscrub button 26 will provide an aggressive application of scrubbing force to the floor or surface being maintained by substantially increasing the torque in the tools for a predetermined duration of time, for example, 15 seconds, after which the control will revert to its previous setting.

Select button 24 is connected to a four-bit counter 28 which provides a binary output that is connected to a decoder 30. Also connected to the decoder is a head position display 32 and a position reset circuit 34. Display 32 visually indicates to the operator the selected level of tool torque. The reset circuit 34 is arranged so that the decoder 30 will reset after having cycled through the number of tool torques available to a particular machine As will be described herein, there are multiple possible discrete tool torques which are available to the operator. Different types of machines may have different numbers of such discrete tool application torques. In the example machine there are six.

The output from decoder 30 is a digital signal which is connected to a selector switch 36. Connected to selector switch 36 are a plurality of tool torque control circuits designated tool torque #1 through tool torque #6 and given the numbers 38 through 48, respectively. Each of these circuits will provide a voltage which may be initially set through a conventional variable resistor and thereafter will be fixed, which voltage is representative of a desired tool torque. Tool torque control circuits 38 through 48 are readily removable and can easily be replaced with other units of different value if desired in a different application. Selector switch 36, as controlled by the successive closing of select button 24, will connect one of the selected voltages to a further selector switch 50 which also has an input from superscrub button 26 through a timer circuit 52. As indicated above, the superscrub period of operation is of a timed duration, as controlled by timer 52, and this, along with the output from selector 36, provides the inputs for selector switch 50.

It is also possible to provide an infinitely variable range of torque rather than discrete steps by replacing select button 24 with a variable potentiometer connected to selector 50. This would eliminate the need for counter 28, decoder 30, reset 34, selector 36 and tool torques 38 through 48. Display 32 could be connected to the potentiometer.

In the example described herein, there are two tool drive motors, although the invention is equally applicable to a surface maintenance machine which has more than two or only a single tool drive motor. The tool drive motors are indicated at 54 and 56 and in a mobile machine of the type illustrated in FIG. 1 will be battery powered conventionally by a 36-volt supply as indicated. The supply voltage for the two tool motors will be available at tool motor terminals 58 and 60 which correspond to tool motors 54 and 56, respectively. For purposes of controlling tool torque, it is only necessary to sense the load current in one of the two tool motors and a sensing device 62, which may be in the form of a toroidal core or coil surrounding the line that carries tool motor load current, will perform this function. The output of core 62, which is a voltage indicative of the load current in one of the two tool drive motors, provides one input to a current sensor amplifier 64. The other input for the amplifier is from selector switch 50 and this input is used to control the gain of the amplifier. A power supply 66 is also connected to amplifier 64. The output from amplifier 64 is a voltage indicative of load current in one of the two tool drive motors as modified or amplified by the signal representing the desired tool torque.

Tool torque #1 represents the lightest tool torque that can be selected, while #6 represents the heaviest torque, with #2, #3, #4 and #5 in between. Tool torque #1 sends a relatively high voltage to current sensor amplifier 64, while #2 through #6 send progressively lower voltages. These voltages control the gain of amplifier 64, so the greatest gain occurs when tool torque #1 is selected, and the least gain occurs when tool torque #6 is selected.

When the machine is applying a heavy torque to the tools, there will be a relatively large load current in tool motor 54, and core 62 will send a relatively high voltage signal to amplifier 64. This signal will receive relatively little amplification from tool torque #6, control circuit 48.

Conversely, when the machine is applying a light torque to the tools, there will be a relatively small load current in tool motor 54, so toroidal core 62 will send a relatively low voltage signal to amplifier 64. This signal will be strongly amplified by the input from tool torque #1, control circuit 38.

In this way, the current output of amplifier 64 is at one particular voltage whenever the applied tool torque is in agreement with the selected tool torque, regardless of which tool torque has been selected, and will vary up or down from that reference voltage as the tool torque varies due to working conditions.

The output from amplifier 64 is connected to a switching device 68 which is effective to connect either the output of the amplifier or signals representative of certain other control functions, which will be discussed later, to an integrator 70. The output from integrator 70 is connected to an up comparator 72 and a down comparator 74. The up comparator will have an upper level reference and the down comparator will have a lower level reference and, in the event the voltage output from integrator 70 exceeds the reference for comparator 72, or is below the reference for comparator 74, there will be appropriate signals to cause up or down movement of the surface maintenance tools. This will vary the applied tool force against the surface being maintained, which will vary the torque in the tools and hence the current in tool motor 54, so the control loop will be closed and the applied tool torque will be maintained at the value selected by the operator.

The system is sensitive and could cause the actuator to continually react, which would shorten its life, so a neutral deadband is provided in comparators 72 and 74. A signal near zero will not be passed to the power preamplifier 76, so no signal will be sent to the actuator until the signal in the comparators exceeds the deadband. It has been found that the width of this deadband should be roughly proportional to the motor load, so a deadband select 112 is provided. It receives an input from selector 50, and serves to control the width of the deadband according to the set point motor load. The deadband will be narrower when the motor load is light, and wider when the motor load is heavy. It can be adjusted to make the actuator response more or less sensitive, as experience may dictate.

Integrator 70 includes a low pass filter that smooths out transients in the load sensor amplifier signal which might result from undulations in the floor or vibrations of the machine itself. The gain of this filter is set for the type of operation that the machine is performing. For example, a burnishing operation requires a very light tool torque and this torque must be held nearly constant. For a burnishing machine the filter could be set at a high gain, which would pass most of the load sensor amplifier signal wave form and cause the actuator to react very sensitively. Scrubbing, however, requires a greater tool torque that is less sensitive to floor variations. For a scrubber the filter would be set for a lower gain, which would dampen out many of the peaks in the load sensor amplifier signal. The actuator would be less sensitive in its reaction, and this would prolong its life. The effects of the low pass filter and the neutral deadband on the signal which is fed to the actuator are shown diagrammatically in FIG. 5.

The outputs from comparators 72 and 74 are connected to a power preamplifier 76 which also receives inputs from speed control circuits 78 and 80. These are pulse width modulating controls which control how fast the surface maintenance tools are raised or lowered. They can be initially set as desired and thereafter require no attention. The output of amplifier 76 is connected to two Mosfet amplifiers 82 and 84 which further process the comparator outputs so that they are at a signal level effective to drive an actuator 86 which will raise or lower the surface maintenance tools. Also connected to amplifiers 82 and 84 is a diagnostic display 88 which may be used by maintenance personnel to determine if the tool torque control system is electrically functional.

The control system also includes a manual raise switch 90 which is connected directly to integrator 70 and provides an electric signal which is effective to raise or lift the tools for any reason which might be required by the machine operator.

Connected to tool motor terminals 58 and 60 is a sensing comparison circuit 92 which is effective to determine if the tool motor load supply voltage is the same for each motor and if the voltage level is above a predetermined minimum required for satisfactory operation of the surface maintenance machine. Assuming that the level of voltage applied to each motor is above the predetermined level, and assuming that the voltage levels are the same, the comparison circuit will have an output to tool motor on detector 94 which provides an output to an inverter 96. The inverter 96 provides one of the two required inputs to timer 52 to permit a superscrub operation. In the event that the comparison indicates that the tool motor supply voltages are unequal or that the voltage level is below the predetermined minimum, a signal will go from detector 94 to a disable circuit 98 which is connected to selector circuit 68. There will also be an output from detector 94 through inverter 96 to tool lift timer 100. Timer 100 is further connected to selector circuit 68, as are a raised position circuit 102 and an off position circuit 104.

Under normal operating conditions, when the machine is first turned on the tool torque selector circuit will automatically be in tool torque #1. Assuming that the tool motor voltages are the same and above the predetermined level required for satisfactory operation, inverter 96 will provide one of the required inputs to timer 52. The operator can then select any desired tool torque or the superscrub torque which, if selected, will be for the duration of the period permitted by the timer 52. In the event the operator wants a tool torque other than that provided by tool torque #1, successive operation of switch 24 will cause decoder 30 to cycle through as many tool torque settings as are available for a particular machine. In the illustrated example, this is 6. After a desired tool torque has been selected, a voltage representative of that torque will be passed by selector 50 to one input of amplifier 64. Amplifier 64 receives another input from toroidal core sensor 62, which input is indicative of the actual level of load current in one of the two tool drive motors. The load current signal will be amplified by the desired tool torque signal and applied through selector switch 68 to integrator 70. After removing any undesired transients, the output will be passed to the up and down comparator circuits 72 and 74. If the actual load current is above that required for a desired tool torque, up comparator 72 will send a signal to raise the tools until the actual load current, as amplified by the tool torque selection, is within the window defined by the two comparators. On the other hand, if the actual load current is below that required for a desired tool torque, down comparator 74 will send a similar signal to lower the tools until the amplified load current signal is within the window. Thus, a desired tool torque from among the discrete torque settings available to the operator is selected and the control circuit described will maintain the tool torque at the desired level by the comparison circuit described.

In the event that comparison circuit 92 indicates either that the tool drive motor supply voltages are unequal or that the supply voltage is below that required for satisfactory operation, a signal will be given to disable circuit 98 and tool lift timer 100. The timer will send a signal to selector 68 which will permit the voltage from circuit 102, at a level to cause the tools to be raised, to pass to the integrator and then to the comparators to effect a raising of the tools. After the timed interval provided by timer 100, disable circuit 98 will cause a voltage from circuit 104 to pass through selector circuit 68 to shut off the machine.

The tool lift timer 100 is useful because it eliminates the need for a mechanical limit switch on actuator 86 to control the upper limit of its stroke. The timer 100 is set to pass current for the time that the actuator requires for full stroke and then shut off. In the event that the actuator should reach the upper end of its travel before timer 100 shuts off, Mosfet amplifier 82 can go into a current limiting mode to prevent excessive current flow in the actuator. Both it and Mosfet amplifier 84 can also shut the circuit almost entirely off in case of a direct short in the actuator or the lines going to it, to protect the electronic circuit board as well as the actuator.

It has been found that a very smooth floor may not provide enough resistance to the tools to develop the desired tool motor load if a heavy value of tool turque has been selected. In this situation the actuator 86 or 286 would be extended to the lower limit of its stroke and still the system would be calling for it to extend further. To prevent this, a proximity sensor 106 is mounted to sense when the actuator has extended to nearly its full stroke. The signal from this sensor is amplified by amplifier 108 and then sent to disable 110, which stops any further extension of the actuator.

The control circuit described is universal in that it may be applicable to various types of surface maintenance machines. Thus, the full range of possible tool torque selection may not be used on every machine and it is for that reason that the circuit includes reset 34.

The digital outputs from decoder 30 which are representative of a particular selected tool torque similarly have multiple uses. Not only do they determine which tool torque voltage is sent to the described comparison circuits, but the digital outputs can also be used to turn on or off vacuum fans, water supplies, detergent supplies and the like. Further, in a particular selected tool torque, the tool may perform a burnishing operation which will require additional auxiliary functions not normally associated with scrubbing or sweeping and the digital outputs can be used to insure that such auxiliary functions are performed.

The current sensor which utilizes a toroidal core 62 is a non-contact type of sensor which is advantageous in that it does not require a discontinuity in the motor supply lines. Alternative current sensors may be used, however. For example, a shunt of known low resistance may be placed in the lead to motor 54 and the voltage drop across the shunt used as an indicator of the current flow to the motor.

Figure 3:
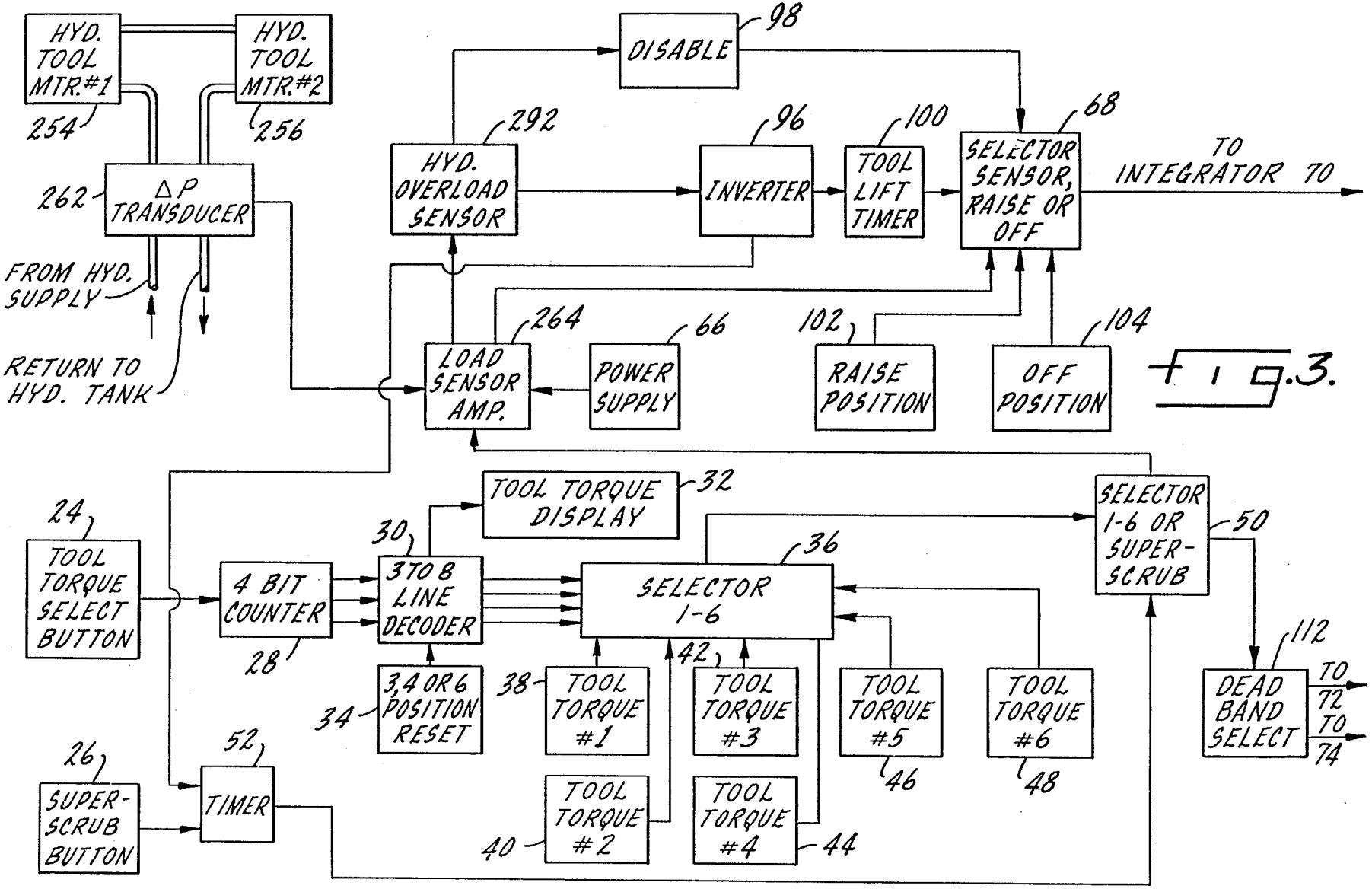
FIG. 3 is a block diagram, similar to FIG. 2A, but illustrating hydraulic motors for driving the brushes.

FIG. 3 illustrates the same control circuit as disclosed in FIG. 2A, but using hydraulic tool motors. Like parts have been given identical numbers. In FIG. 3 the electric tool motors of FIG. 2A have been replaced with hydraulic tool motors 254 and 256, which again could be either one or more tool motors. Toroidal core 62 has been replaced with a differential pressure transducer 262. The safety sensing comparator 92 has been replaced with a hydraulic overload sensor 292. Load sensor amplifier 64 has been replaced with load sensor amplifier 264. The tool motor on detector 94 has been eliminated.

In operation, hydraulic tool motors 254 and 256 are connected in series with each other and a conventional source of pressurized hydraulic fluid. Differential pressure transducer 262 is connected across the hydraulic supply and return lines for the motors, as illustrated by the arrows, so that this device senses the pressure drop across the motors. Transducer 262 will provide an electrical signal which is representative of that pressure drop and this signal is sent to load sensor amplifier 264. This arrangement is analogous to the signal sent by toroidal core 62 to load sensor amplifier 64. Load sensor amplifer 264 is similar to load sensor amplifier 64 and functions in the same way, except that it has an added output to hydraulic overload sensor 292. Sensor 292 functions to protect the system in case of an overload condition in the hydraulic motors in a manner that is similar to the function of safety sensing comparison 92. Sensor 292 sends a signal to disable circuit 98 which causes the tool lift actuator 86 to raise the tools and to shut them off after a period of time controlled by timer 100. All of the other circuits in FIG. 3 are the same in function as described in connection with FIG. 2A. The output from selector sensor 68 of FIG. 3 is connected to integrator 70 such that the combination of FIG. 3 and FIG. 2B will function, for the hydraulic tool motors 254 and 256 just as the combination of FIGS. 2A and 2B function for electric motors 54 and 56 of FIG. 2A.

If the floor maintenance machine uses hydraulics as the driving force for the motors, it may also be desired to use a hydraulic actuator instead of an electric actuator to raise and lower the maintenance tools. Such an arrangement is illustrated in FIG. 4. Electric actuator 86 has been replaced with hydraulic actuator 286 which has an electrohydraulic control 285 associated therewith. A conventional source of pressurized hydraulic fluid is connected to control 285. Mosfets 82 and 84, which are the same as in FIG. 2B, will function to cause the actuator to move up or down. The only distinction between the arrangement of FIG. 4 and the electric arrangement illustrated in FIG. 2B is that there is an electrohydraulic control 285 instead of the electric actuator 86.

Whereas the preferred form of the invention has been shown and described herein, it should be realized that there may be many modifications, substitutions and alterations thereto.

The embodiments of the invention in which an exclusive property or privilege is claimed are defined as follows:

1. An automatic tool torque compensator for a surface maintenance machine including means for raising and lowering one or more surface maintenance tools, motor means for driving the surface maintenance tools, means for sensing the load in said motor means and for providing an electrical signal representative thereof, means for selecting a desired tool torque from a plurality of possible tool torques and for providing an electrical signal representative thereof, and means for utilizing said electrical signals to control the operation of said means for raising and lowering the surface maintenance tools to maintain the desired tool torque.

2. The automatic tool torque compensator of claim 1 further characterized in that said motor means are electrically driven.

3. The automatic tool torque compensator of claim 1 further characterized in that said motor means are hydraulically driven.

4. The automatic tool torque compensator of claim 1 further characterized by and including amplifying means arranged to amplify the electrical signal representative of said motor means load, with the gain of said amplifying means controlled by the electrical signal representative of the desired tool torque.

5. The automatic tool torque compensator of claim 4 further characterized by and including comparison means connected to said amplifying means and to the means for raising and lowering the surface maintenance tools to compare the output of said amplifying means with a reference to thereby maintain the desired tool torque.

6. The automatic tool torque compensator of claim 1 further characterized in that said plurality of possible tool torques include multiple defined levels of tool torque.

7. The automatic tool torque compensator of claim 6 further characterized by and including means for providing multiple electrical signals, each representative of one of said multiple defined levels of tool torque.

8. The automatic tool torque, compensator of claim 7 further characterized by and including switch means for selecting one of said multiple defined levels of tool torque, said switch means including a selector switch connected to said multiple electrical signals, and a sequencing circuit connected to said selector switch.

9. The automatic tool torque compensator of claim 7 further characterized by and including a timer associated with the means for providing one of said multiple defined levels of tool torque electrical signals, said timer limiting the period in which that level of tool torque can be applied to the surface maintenance tools.

10. The automatic tool torque compensator of claim 1 further characterized by and including means for sensing an abnormal operating condition in said motor means, and means for providing an electrical signal representative thereof to effect an automatic raising of said surface maintenance tools.

11. An automatic tool torque compensator for a surface maintenance machine including means for raising and lowering one or more surface maintenance tools, motor means for driving the surface maintenance tools, means for sensing the load in said motor means for driving the surface maintenance tools and for providing an electrical signal representative thereof, means for providing a plurality of discrete electrical signals each representative of a desired level of tool torque, amplifying means having one input of the electrical signal representative of motor load and another input of one of said plurality of discrete electrical signals, with said latter electrical signal controlling the gain of said amplifying means, with the output of said amplifying means being a signal representative of motor load modified in accordance with a desired level of tool torque, comparison means connected to said amplifying means and comparing the output thereof with a reference electrical signal to control the means for raising and lowering said one or more surface maintenance tools to maintain the desired level of tool torque.

12. The automatic tool torque compensator of claim 11 further characterized in that said comparison means includes an integrating circuit to control the response of said comparison means.

13. The automatic tool torque compensator of claim 11 further characterized by and including switch means for selecting a desired level of tool torque and its associated electrical signal.

14. The automatic tool torque compensator of claim 11 further characterized by a neutral deadband in the signal supplied to the raising and lowering means, the width of said deadband being automatically variable in accordance with the desired level of tool torque.

* * * * *